United States Patent [19]

Yamada et al.

[11] Patent Number: 4,825,816

[45] Date of Patent: May 2, 1989

[54] ENGINE WITH FORCED AIR-COOLING

[75] Inventors: Kiichiro Yamada; Tsuyoshi Nishida, both of Sakaishi, Japan

[73] Assignee: Kubota, Ltd., Osaka, Japan

[21] Appl. No.: 92,224

[22] Filed: Sep. 2, 1987

[30] Foreign Application Priority Data

Sep. 3, 1986 [JP] Japan ..... 61-207373
Sep. 3, 1986 [JP] Japan ..... 61-135412[U]
Dec. 30, 1986 [JP] Japan ..... 61-312800

[51] Int. Cl.[4] ..... F01P 9/04

[52] U.S. Cl. ..... 123/41.57; 123/41.42; 123/41.82 R

[58] Field of Search ..... 123/41.33, 41.57, 41.42, 123/41.82 R

[56] References Cited

U.S. PATENT DOCUMENTS 3,160,148 12/1964 Giacosa et al. ..... 123/41.57
3,554,171 1/1971 Herschmann et al. ..... 123/41.57 X
3,741,173 6/1973 Christian ..... 123/41.57

FOREIGN PATENT DOCUMENTS 1751407 7/1971 Fed. Rep. of Germany ... 123/41.57
1751408 7/1971 Fed. Rep. of Germany ... 123/41.57
2609844 9/1977 Fed. Rep. of Germany ... 123/41.82 R
3303347 8/1983 Fed. Rep. of Germany ... 123/41.57
706974 4/1954 United Kingdom ..... 123/41.82 R
2000223 1/1979 United Kingdom ..... 123/41.57
2127487 4/1984 United Kingdom ..... 123/41.57

*Primary Examiner*—Tony M. Argenbright
*Attorney, Agent, or Firm*—Lowe, Price, Leblanc, Becker & Shur

[57] ABSTRACT

In a forced air-cooled engine, a local high temperature portion is adapted to be cooled effectively so that thermal distortion and thermal breakage of a cylinder and/or a cylinder head caused by such a local high temperature can be avoided. To prevent thermal distortion of the engine, there is provided a cylinder jacket, for cooling part of an engine cylinder in a partition wall between the cylinder and its push rod chamber. As means for preventing the thermal distortion of the cylinder head, there is provided a cooling air passage in a cylinder head, and there is also provided a head jacket for oil-cooling around a divided combustion chamber so as to circulate oil through the head jacket and a radiator. Local high temperature portions in the cylinder and/or the cylinder head can thus be oil-cooled effectively.

8 Claims, 10 Drawing Sheets

ENGINE WITH FORCED AIR-COOLING

BACKGROUND OF THE INVENTION

1. Field of the Invention

The present invention relates to an overhead-valve type forced air-cooled engine having an intake valve and an exhaust valve provided in a cylinder head thereof.

2. Background of the Prior Art

In such a forced air-cooled engine, a cylinder and/or a cylinder head are adapted to be cooled by the cooling air flow generated by a cooling fan. However, there exist portions locally kept at a high temperature in the cylinder and/or the cylinder head.

In this basic engine, a push rod chamber is provided at one side of the cylinder chamber, hence a partition wall between the cylinder and the push rod chamber is exposed to a high temperature from a combustion chamber at one side thereof and is isolated from the cooling effect of cooling air flow by the push rod chamber at its other side. It is, thereof, apt to reach such a high temperature that thermal distortion is caused in the cylinder due to uneven temperature distribution in the cylinder wall.

In such high-powered engines, this is a serious matter because a large amount of heat is generated in the engine. Such thermal distortion is apt to cause poor contact between a piston ring and an inner surface of a cylinder, which results in a decrease of engine power and engine durability due to uneven abrasion at the inner surface of the cylinder and, in a worst case, may cause piston squeezing.

And, since a peripheral wall of a divided combustion chamber provided in a cylinder head is apt to be heated locally with the combustion heat generated therein in a divided chamber type forced air-cooled engine, a thermal distortion is caused in the cylinder head and the cylinder head cracks in a worst case.

An example of such a conventional engine, in which the decreases of engine power and engine durability by such thermal distortion of the cylinder are substantially prevented by obtaining an even temperature distribution in the cylinder wall, an oil-cooled engine is disclosed in British Laid Open Patent Publications Nos. 2,127,487 (refer to FIG. 11 hereof) and 2,000,223 (refer to FIG. 12 hereof).

In FIGS. 11 and 12, a cylinder jacket 100 for cooling a whole cylinder 24 is spirally formed around a cylinder wall, and a cylinder head 3 is provided with a head jacket 101. The cylinder jacket 100 is in communication with an oil pan 103 below the crankcase through the head jacket 101 and an oil cooler 102, and the inlet port 104 thereof is in communication with a delivery port 107 of an oil pump 106 in a forced lubrication system 105.

As for the cooling of the cylinder head, there is provided a cylinder jacket through the whole cylinder head as shown in FIG. 11.

However, the above-mentioned prior art has the following disadvantages because the whole cylinder block and/or the whole cylinder head has to be cooled:

(1) the engine becomes larger in size and heavier in weight, because a large oil pump 106 and a large oil pan 103 are required for supplying a large amount of lubricating oil to the cylinder jacket 100 and/or the head jacket;

(2) oil cooler 102 becomes larger in size because of the large cooling capacity required thereof for cooling lubricating oil which also serves to absorb a considerable amount of the heat transferred from the whole cylinder block and/or the head jacket.

SUMMARY OF THE INVENTION

The present invention is directed to solving the problems noted above, and has for its main object to provide a forced air-cooled engine wherein a local high temperature portion is adapted to be cooled effectively so that a thermal distortion and a thermal breakage of a cylinder and/or a cylinder head caused by such a local high temperature can be avoided. Particularly, in an overhead-valve type forced air-cooled engine a thermal distortion of a cylinder is prevented so that decreases in engine power and engine durability as well as possible piston squeezing caused by the thermal distortion can be avoided. Further, in a divided chamber type forced air-cooled engine, a thermal distortion and a thermal breakage of a cylinder head is adapted to be prevented.

Another object of the present invention is to make an engine more compact as a whole by designing a smaller-sized engine body and a smaller-sized oil cooler.

The means of the present invention for accomplishing the above purpose is a forced air-cooled engine, wherein a local high temperature portion of a cylinder and/or a cylinder head being oil-cooled partially so that a thermal distortion can be avoided.

Therefore, in an overhead-valve type forced air-cooled engine, since lubricating oil is adapted to effectively cool the partition wall between the cylinder and the push rod chamber during its passage through the cylinder jacket in order to cool part of the cylinder, the temperature distribution in the circumferential wall of the cylinder is evened out so as to prevent a thermal distortion of the cylinder.

Also, on the one hand, there is provided a cooling air passage in a cylinder head and on the other hand, there is provided a head jacket for oil-cooling around a divided combustion chamber so as to circulate oil through the head jacket and a radiator. Therefore, since the major part of the cylinder and/or the cylinder head are adapted to be cooled by a forced air-cooling system while a local high temperature portion of the cylinder and/or the cylinder head are cooled by the oil, it is possible to reduce the amount of oil as well as to both the size and the weight of the engine.

Furthermore, since the amount of heat absorbed from the circumference of the cylinder is lesser in the oil-cooling system provided for part of the cylinder than in that provided for the entire cylinder, it is possible to accomplish a reduction in both the cooling capacity and the size of the oil cooler in order to make the engine more compact.

DESCRIPTION OF THE PREFERRED EMBODIMENT

Figure 1:
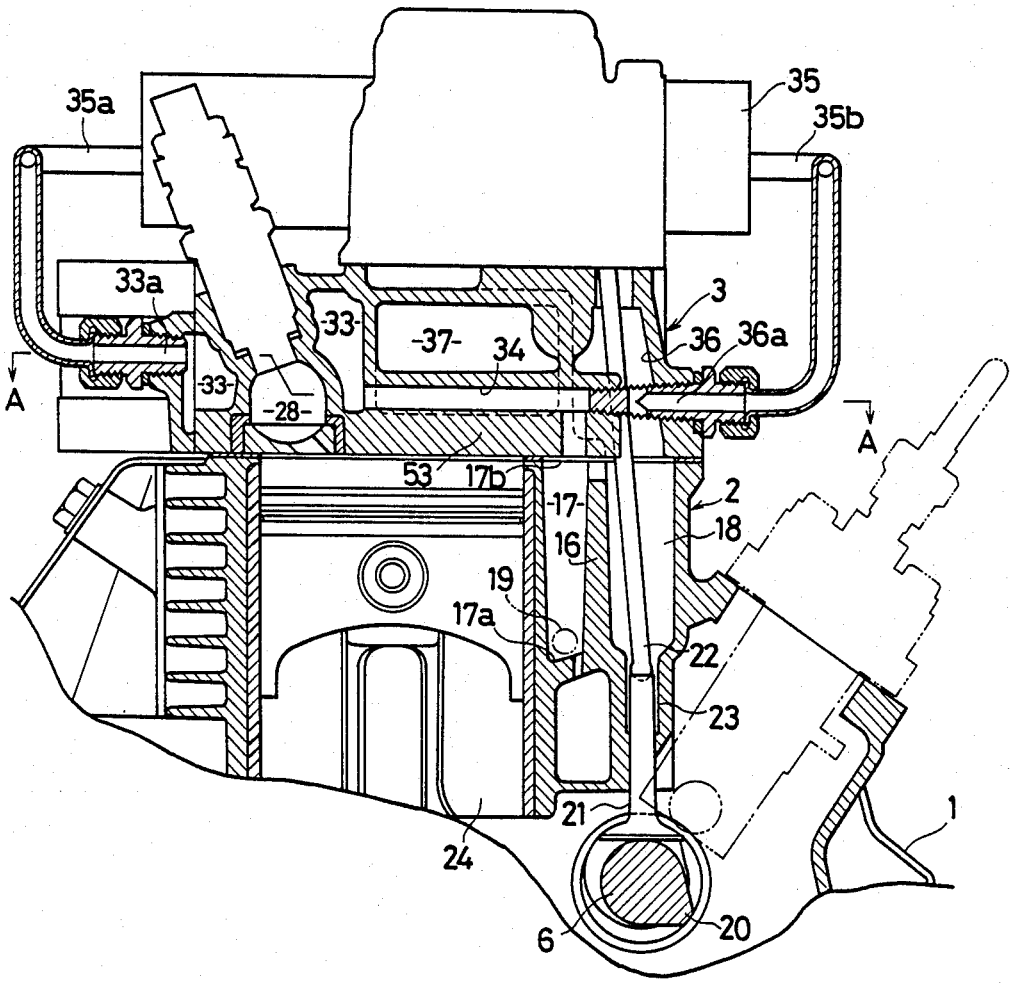
FIG. 1 is a vertical sectional view showing a head block and a cylinder block of an overhead-valve and divided chamber type forced air-cooled vertical diesel engine according to a preferred embodiment of the present invention.
Figure 2:
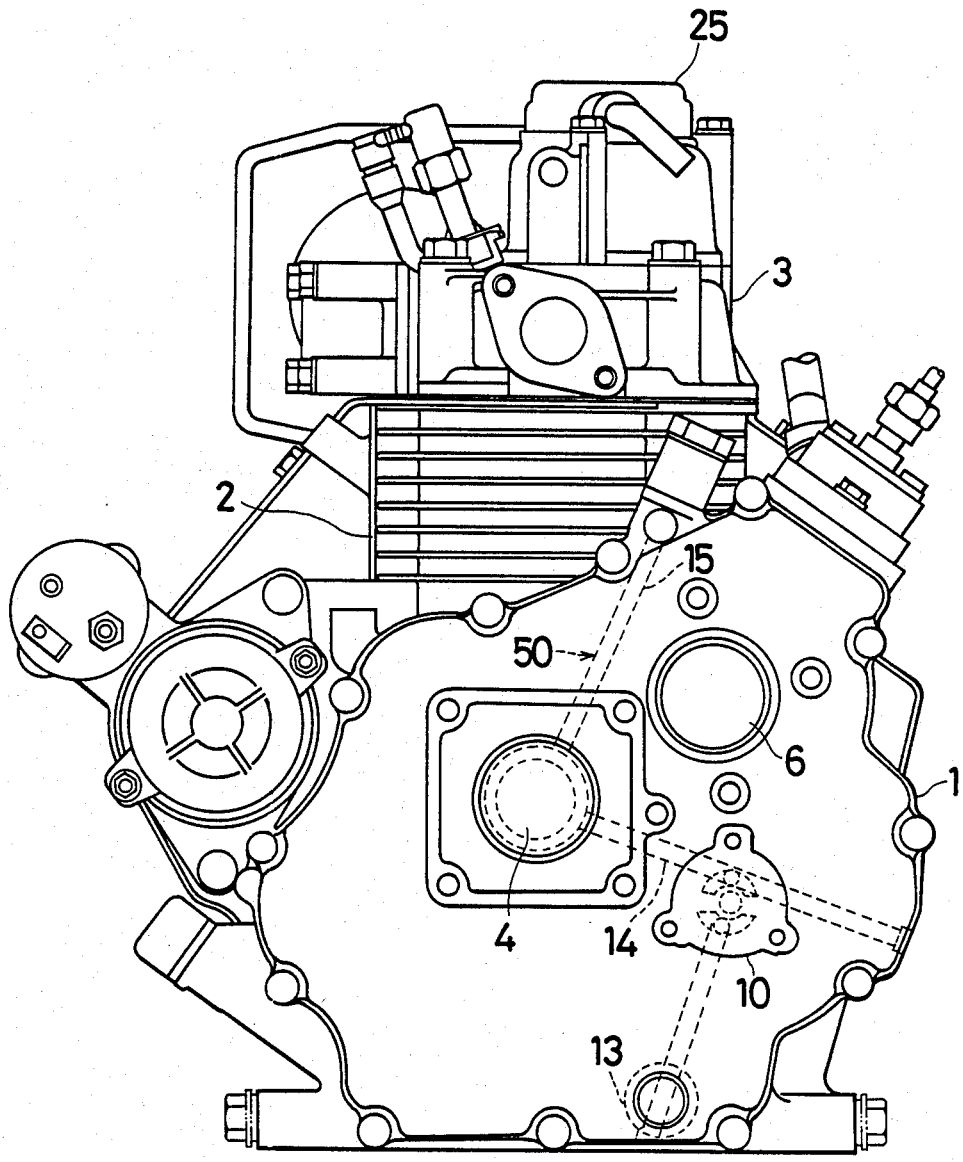
FIG. 2 is a rear elevation view of said engine.
Figure 3:
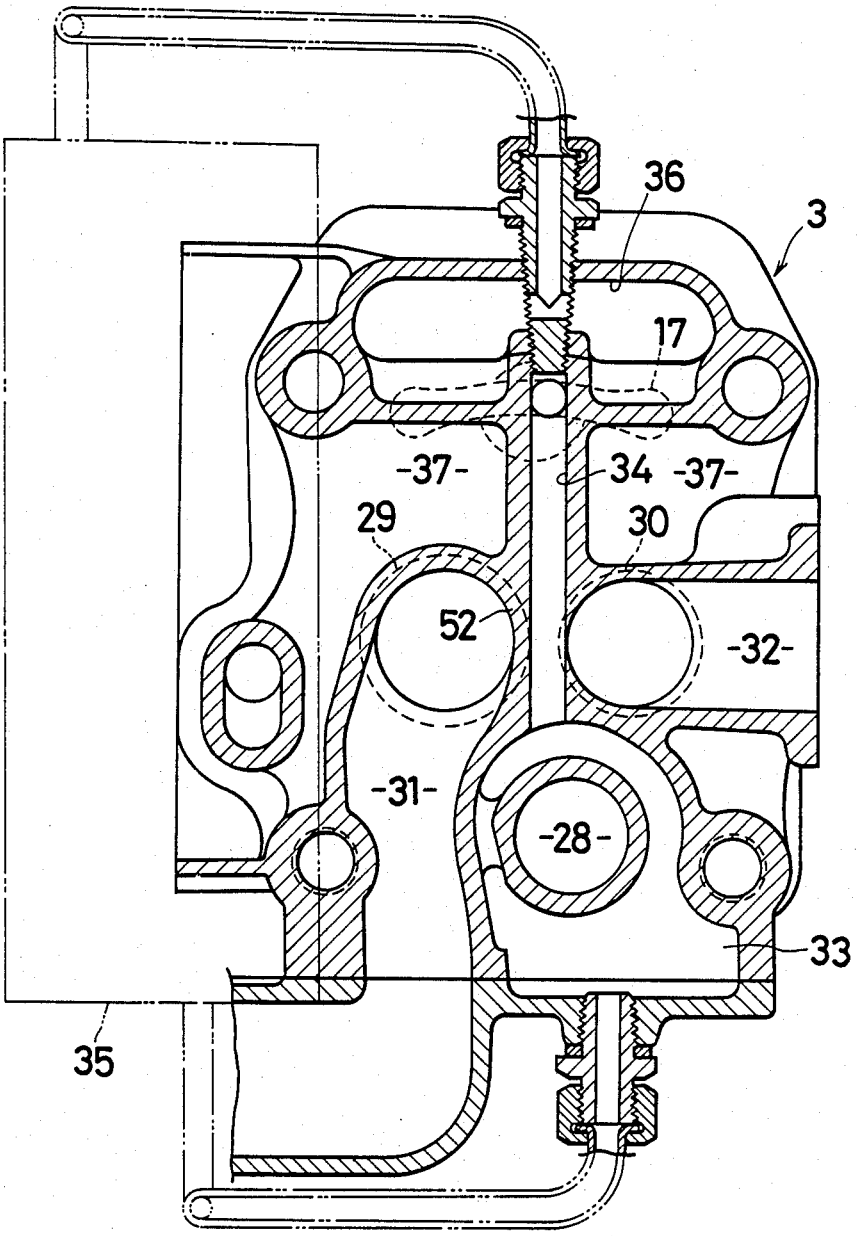
FIG. 3 is a horizontal sectional view of section A—A in FIG. 1.

Preferred embodiments of the present invention will now be described with reference to the accompanying drawings.

As shown in FIGS. 1 through 5, an overhead-valve and divided chamber type forced air-cooled vertical engine includes a crankcase 1 integratedly formed by means of casting of aluminum alloy and a cylinder block 2, on which a cylinder head 3 made of aluminum alloy is secured. Within the crankcase, a crank shaft 4, a balancer shaft 5 and a valve actuating cam shaft 6 are rotatably supported. The crank shaft 4 has a front end portion 4*a* projected forwardly out of the crankcase 1. A cooling fan 7 is fixedly secured to the front end portion 4*a* of the crank shaft 4. The cooling fan 7 and the front end surface are covered with an air guide case 8. Ambient air is sucked by the cooling fan 7 through the suction opening 9 provided at the front portion of the case 8, and the sucked air is guided by the case 8 and supplied as cooling air to the cylinder block 2 and cylinder head 3.

A forced lubrication system 50 comprises an oil pump 10, an oil strainer 13, a lubricating oil supply line 14 and the like. In a back wall 1*a* of the crankcase 1 there is provided an oil pump 10, preferably of a trocoid type. The oil pump 10 is adapted to be driven by the crank shaft 4 through gear means 11 so as to suck lubricating oil through the oil strainer 13 from the oil pan 12 provided in the bottom portion of the crankcase 1, and to then supply the lubricating oil to every portion requiring lubrication in the engine through a supply line 14 formed within the crank shaft 4.

From the lubricating oil supply line 14, a cooling oil service passage 15 is branched off so as to lead to a lower portion of one side of the cylinder block 2 through the back wall 1*a* of the crankcase 1. Within the back sidewall of the cylinder block 2 there is provided a push rod chamber 18 arranged vertically in parallel with cylinder 24. In the partition wall 16 between the push rod chamber 18 and the cylinder 24, there is provided a cylinder jacket 17 for cooling part of the cylinder, which cylinder jacket 17 is vertically extended so as to have an opening at the upper end surface of the cylinder block 2. The inlet 17*a* of the cylinder jacket 17 is in communication with a cooling oil service passage 15 which leads to a delivery port 51 of oil pump 10 through a relief valve 19.

Figure 4:
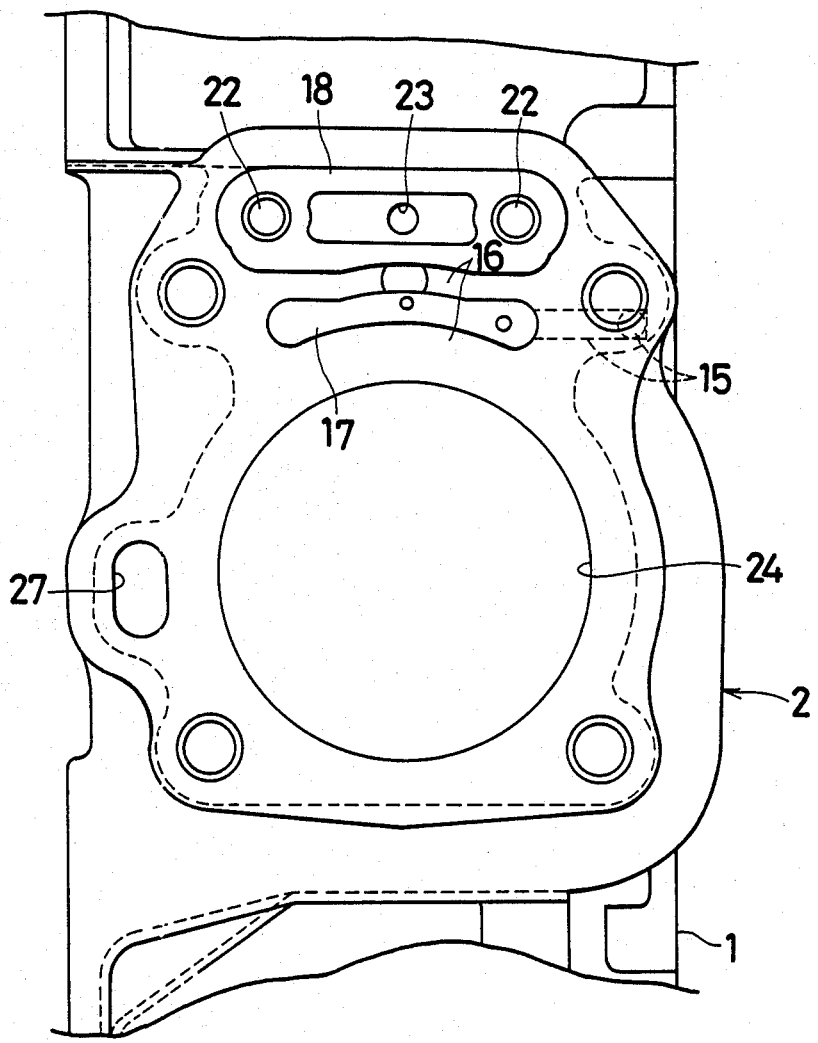
FIG. 4 is a plan view showing the cylinder block of said engine.
Figure 5:
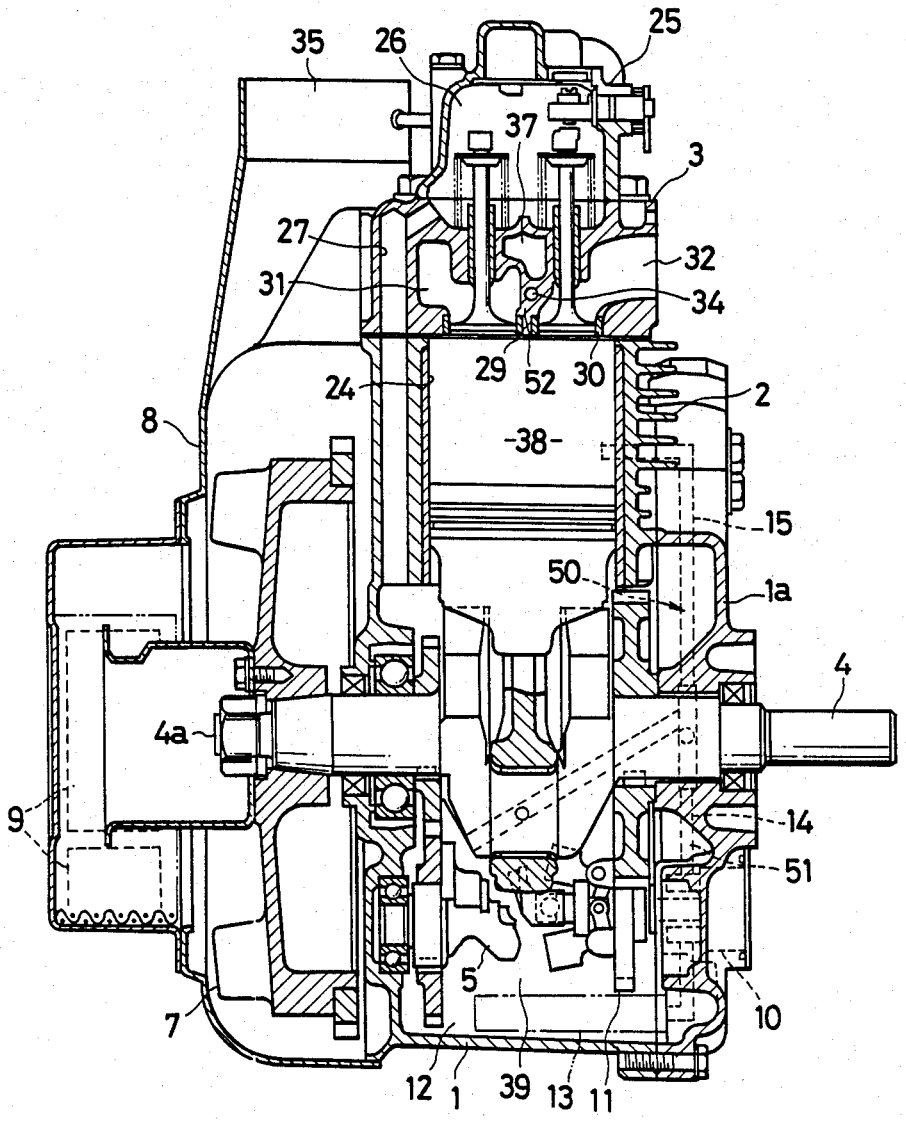
FIG. 5 is a vertical sectional side view of said engine.

In this case, as shown in FIG. 4, the arcuate length of the cylinder jacket 17 in the circumferential direction of the cylinder 24 is defined to be a little shorter than that of the push rod chamber 18.

In the push rod chamber 18, there are provided upper portions of a couple of tappets 21 which are reciprocated vertically by cams 20 secured on the valve actuating cam shaft 6, and push rods 22 which are held in contact with the upper ends of the tappets respectively so as to reciprocate therewith. Push rod chamber 18 has an oil return port 23 formed at the bottom wall thereof which is in communication with the crank chamber 39. Furthermore, in the front portion of the cylinder block 2, there is provided an oil return passage 27 which also serves as a breather passage and connects a rocker-arm chamber 26 within a head cover 25 to a crank chamber 39 within the crankcase 1.

In the cylinder head 3 secured on the cylinder block 2, there are provided a divided chamber 28, an intake valve seat 29, an exhaust valve seat 30, an intake port 31 and an exhaust port 32.

The divided chamber 28 is disposed eccentrically to the right side (but to the left side in FIG. 1 and to the lower side in FIG. 3) as well as a little toward the rear (but to the left side in FIG. 3) relative to the center of the cylinder 24 as viewed from the front side of the engine. The intake valve seat 29 and the exhaust valve seat 30 are disposed respectively at the front side and at the back side on a center line defined in relation to the left and the right of the cylinder head 3. The intake port 31 extends from the intake valve seat 29 to the right side surface of the cylinder head 3 across the front of the divided chamber 28, and the exhaust port 32 extends backwards from the exhaust valve seat 30.

A head jacket 33 for cooling part of the cylinder head 3 is formed over the range from the beginning end of the exhaust port 32 to the peripheral wall of the intake port 31 and around the divided chamber 28 of the cylinder head 3.

An oil passage 34 is formed so as to run from the upper section 53 of the cylinder jacket 17 to the head jacket 33 through the wall 52 between the intake port 31 and the exhaust port 32. That is, the outlet 17*b* is connected in communication with the head jacket 33.

In this case, it is important that the head jacket 33 for cooling part of the cylinder head is provided in a hot portion heated to a high temperature in the cylinder head 3. Such hot portions of the head block, for example, include an exhaust valve seat, a peripheral wall of the exhaust port, a peripheral wall of a divided chamber and the like as described above, which are apt to be exposed and heated to a high temperature. Furthermore, such hot portions include the wall between the intake port and the exhaust port, which cooling air cannot readily get to due to the obstruction of other portions and other parts, as well as ones such as a back side of a cylinder and so on, to which fresh cooling air cannot readily be supplied. In summary, all the portions which cannot be effectively cooled only by a forced air-cooling system, and which therefore attain a high temperature are included in hot portions.

At the undersurface of the cylinder head 3, there is provided a cooling oil outlet passage 36 (see FIG. 3) caved so as to be in communication with the push rod chamber 18. An oil cooler 35 is disposed at the upper section of the air guide case 8 (see FIG. 5) so as to block it there and has an inlet 35*a* connected to the outlet 33*a* of said head jacket 33 and an outlet 35*b* connected to the inlet 36*a* of the cooling oil outlet passage 36.

The oil cooler 35 is adapted to be cooled by a portion of cooling air supplied by the cooling fan 7 and guided by the air guide the event 8. In case that the head jacket 33 is sufficiently supplied with a large enough flow of oil to restrict the temperature rise thereof to a relatively small extent, or the total amount of lubricating oil is large enough to cool down the heated lubricating oil soon after mixing with other portions thereof, the oil cooler 35 may be omitted because the thermal deterioration of said lubricating oil can be prevented effectively for long time without the oil cooler 35.

On hand, at the other portions other than the head jacket 33 in the cylinder head 3, there is provided a cooling air passage 37 for passing the cooling air therethrough. The cooling air passage 37 is so provided, between the push rod chamber 18 and both peripheral walls of the intake port 31 and the exhaust port 32, that the cooling air is supplied thereto under the guidance of the air guide case 8 so as to come in contact with said both peripheral walls during its flow toward the back of the engine therethrough. Further, as shown in FIG. 1, the cooling air passage 37 is formed so as to run lengthwise and also parallel with the oil passage 34 at the upper side of the cylinder head 3, which oil passage 34 runs transversely at the lower side of the cylinder head 3.

The functions of the overhead-valve type forcedly air-cooled engine will now be described.

(1) Although the cylinder head 3 and the cylinder block 2 are adapted to be forced-cooled by the cooling air supplied by the cooling fan 7 and guided by the air guide case 8, the thick partition wall 16 between the push rod chamber 18 and the cylinder 24 is apt to suffer heat accumulation because it is remote from the inner surface of the cylinder 24 as well as from the outer surface of the cylinder block 2. Furthermore, since the partition wall 16 is spaced from the cooling air passage 37 by the push rod chamber 18, it cannot be cooled by the cooling air. Therefore, since the partition wall 16 constitutes a hot portion under such a cooling system comprising only the forced air-cooling system, the temperature distribution in the circumferential direction of the cylinder 24 tends to be uneven. However, the consequential temperature rise in the partition wall 16 can be prevented by cooling it with the lubricating oil. The lubricating oil from oil pan 12 is delivered by the lubricating pump, 10 after being filtered by the strainer 13, to every portion required for lubrication in the engine through the lubricating oil supply line 14. It is also provided to the partition wall 16 through the cooling oil service passage 15 and the relief valve 19 as a spilled-out portion of lubricating oil flow therefrom.

The lubricating oil which flows into the cylinder jacket 17 provided in the partition wall 16 for cooling part of the cylinder serves to absorb the heat accumulated around the partition wall 16 as part of the cylinder 24 so as to effect the cooling thereof. Thus, the temperature rise in the partition wall 16 is prevented and then the temperature distribution in the cylinder 24 is kept substantially even in the circumferential direction thereof by the absorption of the heat accumulated in the partition wall 16 as described above. Furthermore, the generation of thermal distortion in the cylinder block 2, as well as the decreases in engine power and engine durability, due to such thermal distortion are prevented.

Incidentally, although the lubricating oil spilled out of the relief valve 19 at a predetermined pressure is adapted to flow into the cylinder jacket 17 in this embodiment, the relief valve 19 may be omitted so that the lubricating oil can flow into cylinder jacket 17 directly from the cooling oil supply line 15.

(2) The lubricating oil supplied from the cylinder jacket 17 to the head jacket 33 through the oil passage 34 serves to absorb the heat around the peripheral wall of the divided chamber 28 and the thick wall between the intake port 31 and the exhaust port 32 during its passage through the oil passage 34 and the head jacket 33, so as to prevent the temperature rise in portions such as parts of the cylinder head 3 and also to cool intake air through the peripheral wall of the intake port 31. Therefore, the thermal distribution in the cylinder head 3 is evened out so that the generation of thermal distortion in the cylinder head 3 and decreases in engine power and engine durability due to such thermal distortion can be prevented effectively and the charging efficiency for intake air can be enhanced.

Furthermore, in the divided chamber type forced air-cooled engine by the circulation of the oil through the head jacket 33 which is formed only around the divided chamber 28, the peripheral portion around the divided chamber 28, otherwise apt to be heated to a high temperature, is cooled effectively. On the other hand, since the peripheral portion of the divided combustion chamber is cooled by oil even though the other sections of the cylinder head 3 are subjected to the air-cooling, the overcooling of peripheral portion is prevented. Accordingly, since the overcooling for the peripheral portion of the divided combustion chamber is avoided, at the cold start of the engine in a cold season, the warm-up time for engine operation can be shortened.

In a conventional engine wherein the whole of the cylinder head 3 is to be oil-cooled, the cooling oil cannot cool the intake port 31 sufficiently during normal engine operation. Whereas, in the present invention, only the peripheral portion of the divided chamber 28 in the cylinder head 3 is oil-cooled and the intake port 31 is cooled intensively by the cooling air flow generated by the cooling fan 7 as a separate cooling means independent of the oil cooling system so that the charging efficiency for intake air is improved even further and the engine output power is increased.

(4) Moreover, in the case where lubricating oil is used as the cooling oil since the lubricating oil is adapted to be fed to the oil cooler 35 soon after being heated in the head jacket 33 and returned to the oil pan 12 after being cooled well in the oil cooler 35, the temperature of the lubricating oil in the oil pan 12 is kept low enough to prevent its deterioration for a relatively long time.

(5) Since the cylinder jacket 17 for cooling part of the cylinder is formed in the partition wall 16, and the head jacket 33 for cooling part of the cylinder head is formed only around the periphery of the divided chamber 28, the amount of the oil necessary for cooling can be reduced so that reduction of engine dimensions is facilitated by making the capacity of the oil pan 12 smaller.

Since the lubricating oil serves to cool only parts of the cylinder block 2 and the cylinder head 3 respectively, the quantities of heat absorbed during such cooling are less in this cooling system than in the cooling system wherein the entire engine block is oil-cooled, so that a reduction in the oil cooler dimensions is facilitated by reducing the capacity of the oil cooler 35.

(6) It is possible to provide a cooling oil system which includes an oil pump 10, the cylinder jacket 17, the head jacket 33 and the oil cooler 35 independently of the forced lubrication system 50 for the engine. In the preferred embodiment of this invention, however, the oil pump 10 in the forced lubrication system 50 is also simultaneously adapted to serve as an oil pump for a cooling oil system in order to make use of the engine lubricating oil for cooling parts of the cylinder block 2 and the cylinder head 3. Therefore, the overall structure of the engine 1 can be simplified in this case.

(7) Since the oil passage 34 is formed at the lower side of the cylinder head 3 and the cooling air passage 37 is provided at the upper side thereof, the cross section of the cooling air passage can be enlarged to maintain good cooling performance.

(8) Since the core for forming the head jacket 33 is required to be located only around the divided chamber 28, the core supporting and the removal of molding sand after completion of casting the head jacket are carried out readily. Consequently the head jacket 33 is formed readily by casting.

Figure 6:
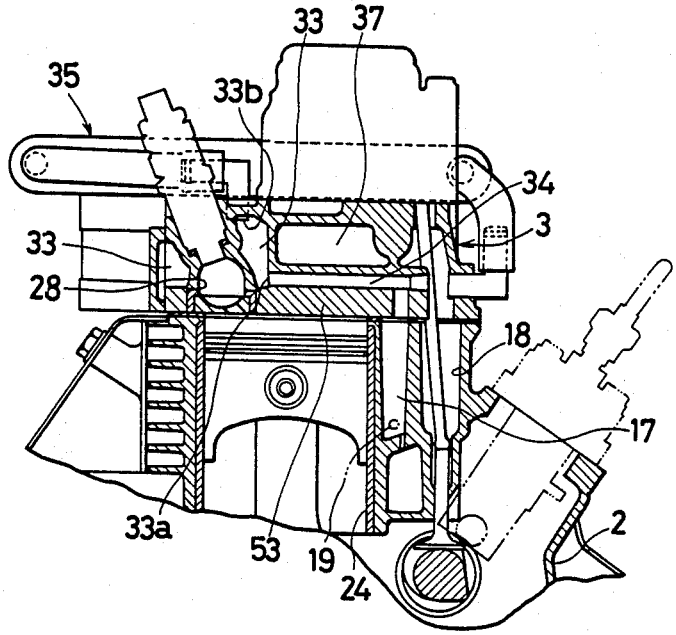
FIG. 6 is a vertical sectional view showing the principal parts of an overhead-valve and divided chamber type forcedly air-cooled vertical diesel engine according to a first variant of the preferred embodiment.
Figure 7:
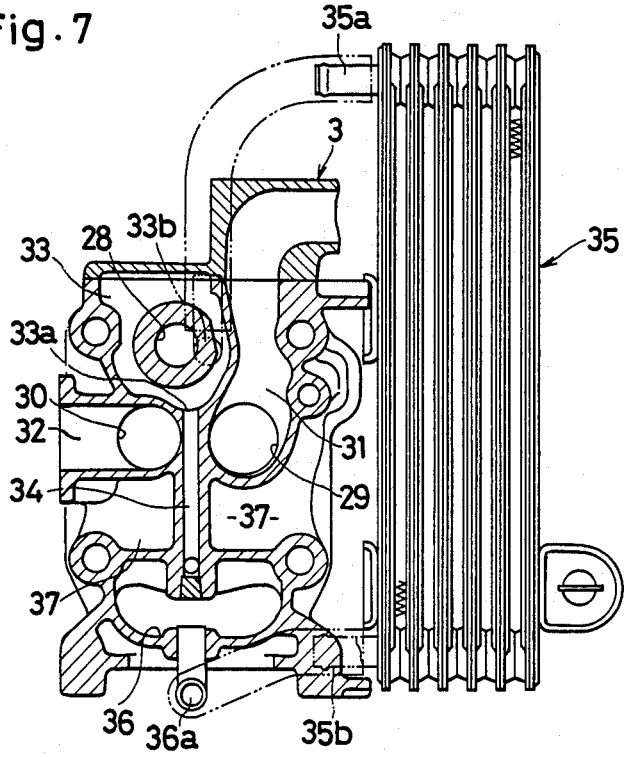
FIG. 7 is a horizontal sectional plan view showing the cylinder head of the engine of FIG. 6.

FIG. 6 and FIG. 7 show a first variation of the preferred embodiment of the present invention.

In the above-mentioned preferred embodiment, the upper end portion of the partition wall 16 between the cylinder 24 and the push rod chamber 18 is cut out so that the lubricating oil can partially overflow from the cylinder jacket 17 to the push rod chamber 18 thereover, whereas in the variation of that embodiment there such a cut out portion is not provided in the partition wall 16, so that all the lubricating oil supplied to the cylinder jacket 17 is adapted to flow into the oil passage 34.

The head jacket 33 for cooling part of the cylinder head 3 has an inlet 33*a* connected with the oil passage 34 at the lower side thereof and an outlet 33*b* opened at the upper portion thereof.

In this construction, since the direction of flow of the lubricating oil within the head jacket 33 is the same as that of the natural convection therewithin, the flow resistance of the lubricating oil in the head jacket 33 becomes smaller and hence the load on the oil pump 10 can be reduced. Furthermore, since the lubricating oil is adapted to move up to the upper side in the head jacket 33 and flow out smoothly therefrom through the outlet 33*b* due to an increase in its temperature, the hot lubricating oil does not remain within the head jacket 33. Accordingly, the cooling effect of the lubricating oil for the head jacket 33 is not adversely affected by a long stay of the hot lubricating oil within jacket 33 and, consequently, more effective cooling for the divided chamber 28 is carried out.

Figure 8:
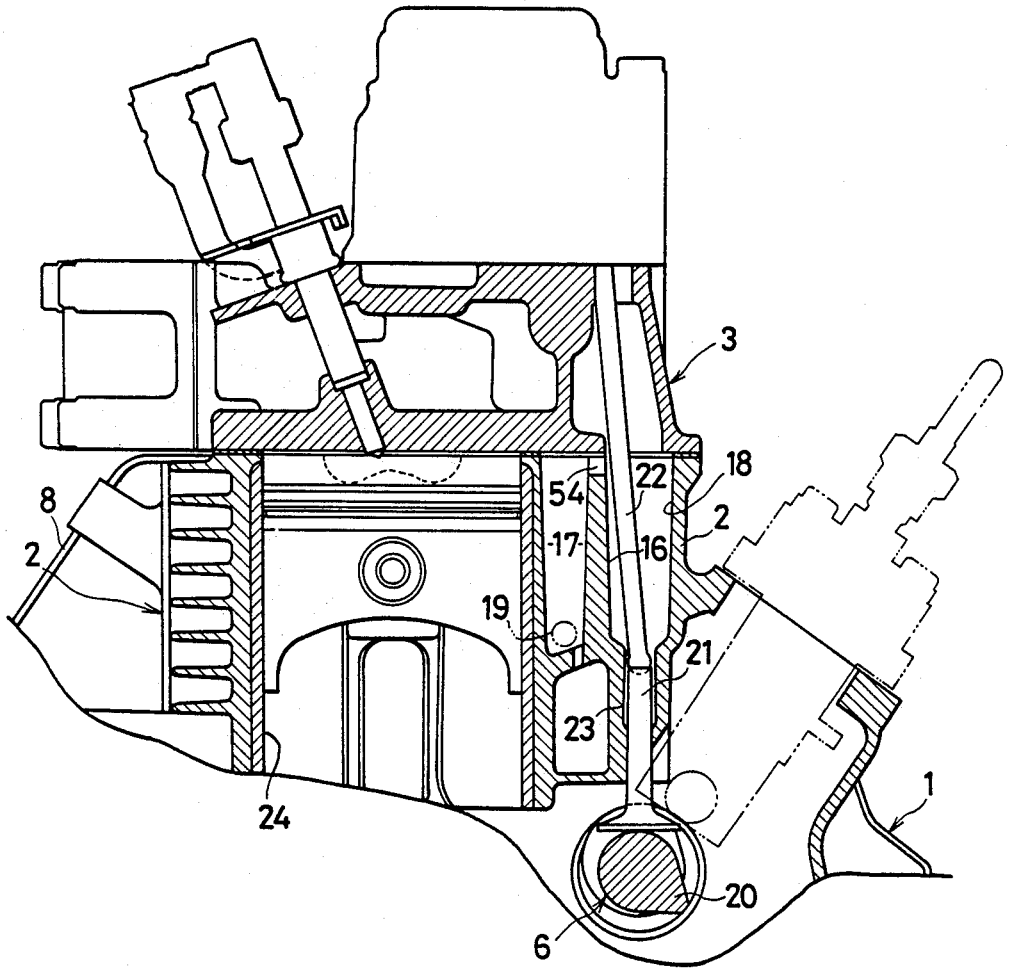
FIG. 8 is a vertical sectional rear view showing the principal part of an overhead-valve and direct-injection type forced air-cooled vertical diesel engine according to second variant of the present invention, wherein the cylinder head shown in FIG. 1 is replaced with another type of cylinder head.
Figure 9:
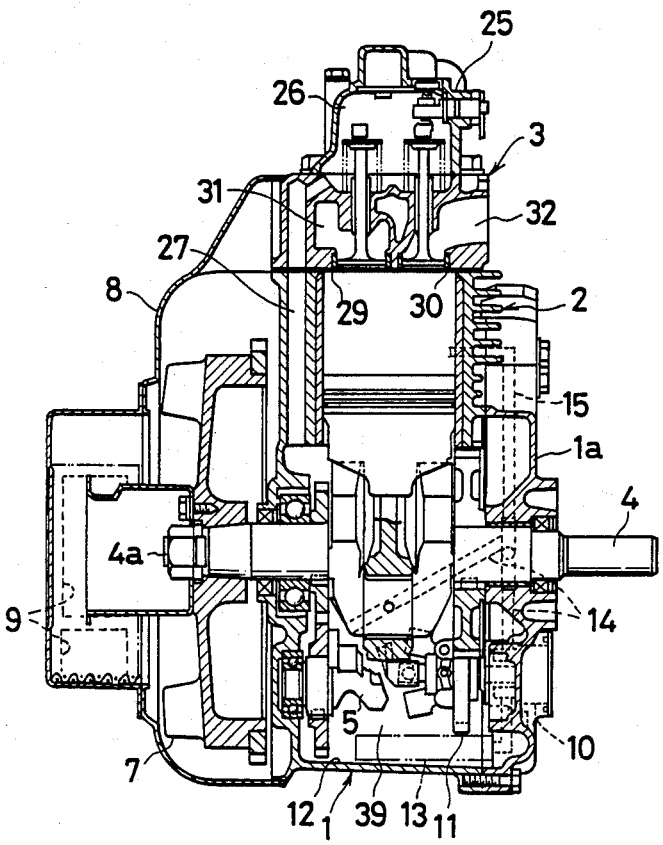
FIG. 9 is a vertical sectional side view of the engine of FIG. 8.

FIG. 8 and FIG. 9 show a second variation of the preferred embodiment of the present invention.

In this second variation oil cooling for the hot portion of the cylinder head 3 is omitted and only part of the cylinder block 2 is adapted to be cooled by the lubricating oil.

Such a partially oil-cooled type cylinder head which includes the head jacket 33 and the oil passage 34, is replaced with a cylinder head cooled only by a forced air-cooling system. For example, for such cylinder head it is desired that thermal distortion be prevented only by the forced air-cooling system like a head block of a direct injection type diesel engine, and the cylinder jacket 17 for cooling part of the cylinder is provided only in the partition wall 16 of the cylinder block 2.

Both cylinder jacket 17 and push rod chamber 18 are extended to the contact surface between the cylinder block 2 and the cylinder head 3.

The arcuate length of the cylinder jacket 17 in the circumferential direction of the cylinder 24 is defined to be a little shorter than that of the push rod chamber 18. The upper end of the cylinder jacket 17 is closedly covered by the lower end surface of the cylinder head 3 and is in communication with the push rod chamber 18 through a cut-out portion 54 provided at the upper end surface of the cylinder block 2 as occasion demands. The push rod chamber 18 is also in communication with oil pan 12 within the crankcase 1 through the oil return port 23 provided in the bottom wall thereof.

Figure 10:
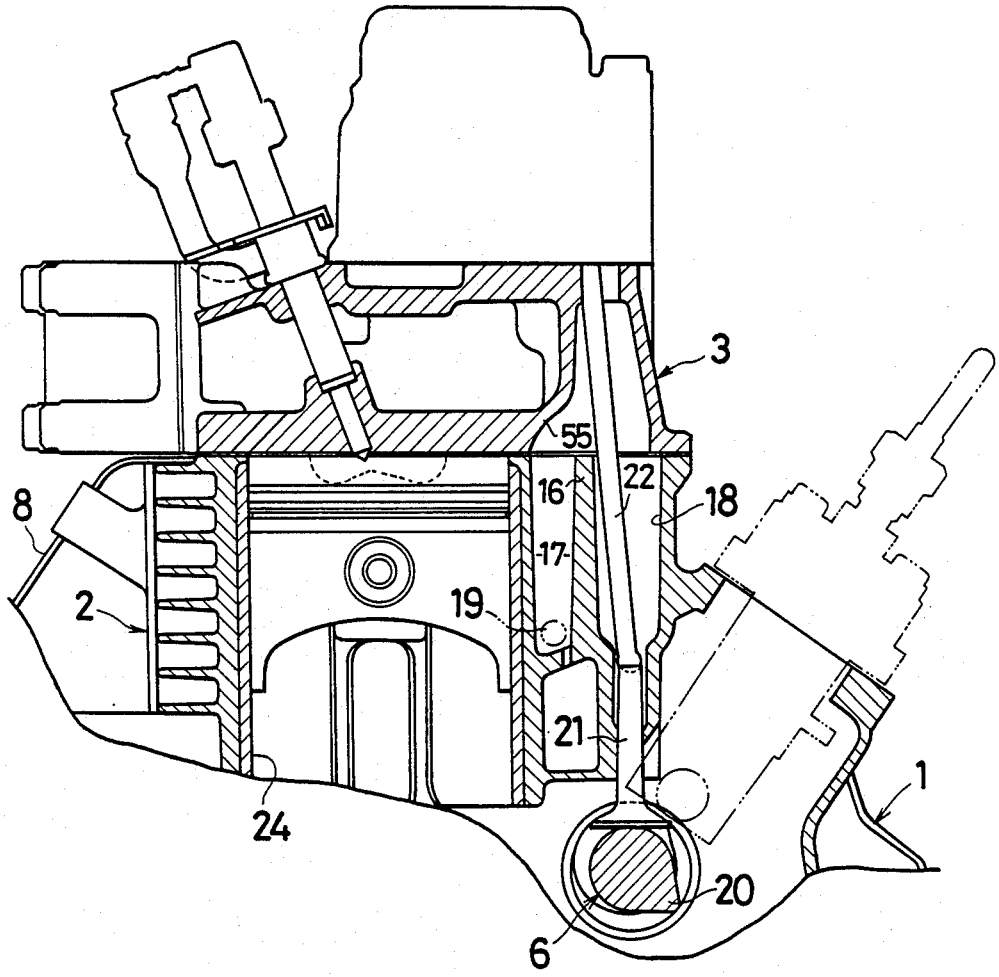
FIG. 10 is a vertical sectional view showing the principal part of an overhead-valve and direct-injection type forced air-cooled vertical diesel engine.
Figure 11:
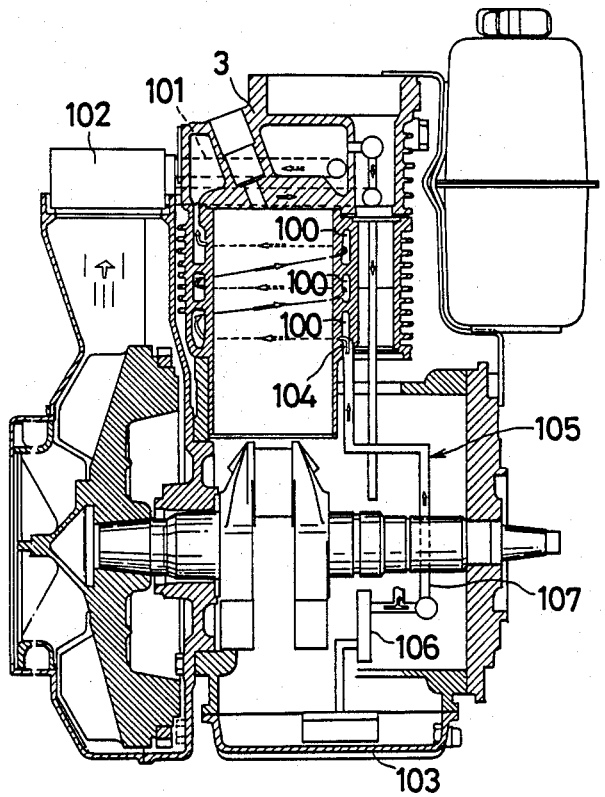
Fig.11 PRIOR ART
FIG. 11 is a vertical sectional view of an overhead-valve type engine known in the prior art.
Figure 12:
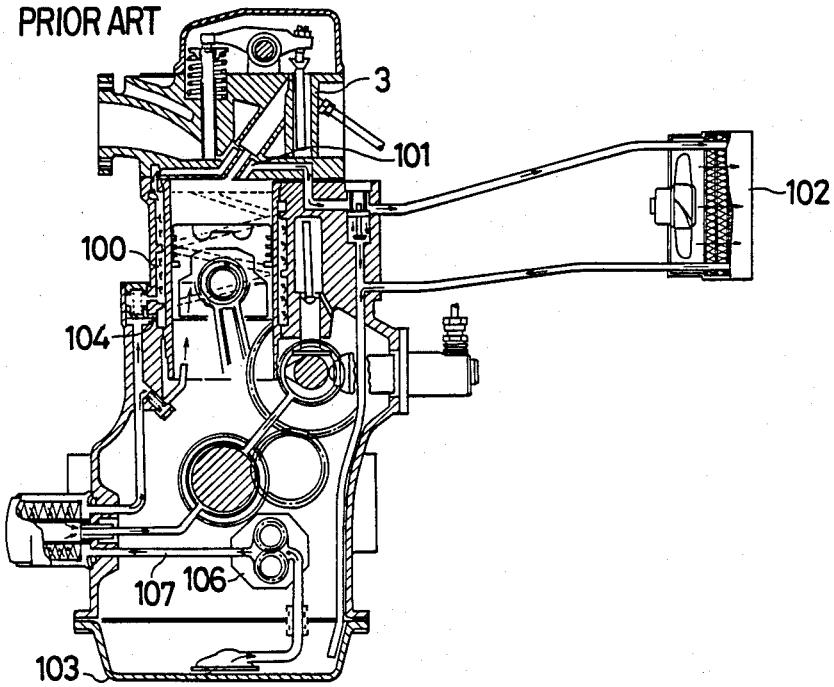
Fig.12 PRIOR ART
FIG. 12 is a view showing the prior art engine of FIG. 11.

FIG. 10 shows a third variation of the preferred embodiment of the present invention, wherein only part of the cylinder block 2 is adapted to be cooled by the lubricating oil, too.

In this third variation, instead of the cut out portion 54 as in the second variation as described earlier, there is provided a concaved portion 55 which is formed in an inclined shape at the under section of the cylinder head 3 opposingly to the cylinder jacket 17 and the push rod chamber 18, and through which the upper portion of the cylinder jacket 17 is in communication with that of the push rod chamber 18.

It is also acceptable that such a cut out portion be formed in part of a gasket put between the cylinder head 3 and the cylinder block 2 so that the cylinder jacket 17 and the push rod chamber 18 are connected to be in communication with each other.

There are numerous advantages associated with above-mentioned second and third variations of the preferred embodiment:

(1) The lubricating oil supplied to the cylinder jacket 17 is further fed to the push rod chamber 18 through the cut out portion 53 of the partition wall 16 or through the concaved portion 54 of the cylinder head 3, after cooling of the partition wall 16, and is then returned to the oil pan 12 through the return hole 23. Accordingly, by this absorbing and removing of the heat accumulated in the partition wall 16 with the lubricating oil, the temperature rise of the partition wall 16 can be prevented effectively. Moreover, the temperature distribution in the circumferential direction of the cylinder 24 can be evened out, the generation of the thermal distortion in the cylinder 24 can be prevented and the decreases of engine power and engine durability by thermal distortion also can be prevented.

(2) Both upper portions of the cylinder jacket 17 and the push rod chamber 18 are in communication with each other at the upper side of the contact surface between the cylinder block 2 and the cylinder head 3, for example by concaving part of the upper end surface of the cylinder block 2 or part of the lower end surface of the cylinder head 3, or by cutting out part of a gasket located between the cylinder block and the cylinder head. Accordingly, the structure of the connecting portion between the cooling oil supply line and the return line can be of simple form and is manufactured readily and inexpensively.

Thus it is possible to adopt a simple structure such that the cut out portion 54 is formed at the upper end surface of the partition wall 16, wherein the cut out portion 54 can be formed readily by means of drilling, milling and known processes of manufacture.

(3) A wholly oil-cooled type or a partially oil-cooled type of cylinder head is installed to the engine and has a lubricating oil supply passage and a lubricating oil return passage each connected respectively to the cylinder jacket 17 and to the push rod chamber 18, both of which are extended to the contact surface between the cylinder block and the cylinder head. Accordingly, engine durability can be improved and improvements in engine quietness can be attained. Furthermore, since it is possible to parts other than cylinder heads of the wholly oil-cooling type, partially oil-cooling type, or of a forced air-cooling type in common for such engines, significant cost benefits can be attained in engine manufacturing.

We claim:

1. An overhead-valve type forced air-cooled engine having a cooling fan for the engine, a forced lubrication system and a cylinder block on which a cylinder head is secured and which has a push rod chamber formed in parallel with a cylinder thereof and fins provided therearound so as to be supplied with cooling air flows generated by a cooling fan in order to cool the cylinder, comprising:

a cylinder jacket for cooling part of the cylinder, provided in a partition wall between the cylinder and the push rod chamber of said cylinder block, and an inlet for said cylinder jacket, in communication with a delivery port of an oil pump in said forced lubrication system, the outlet of said cylinder jacket being in communication with an interior of an oil pan of the engine.

2. An overhead-valve type forced air-cooled engine according to claim 1, wherein:

the outlet of the cylinder jacket is in communication with the interior of the oil pan through the push rod chamber.

3. An overhead-valve type forced air-cooled engine according to claim 1, further comprising:

a head jacket for cooling part of the cylinder head, provided in a hot portion of the cylinder head; and an oil cooler provided in the engine, the outlet of the cylinder jacket being connected in communication with the interior of the oil pan through the head jacket and the oil cooler in that order.

4. An overhead-valve type forced air-cooled engine according to claim 3, wherein:

the engine is a divided chamber type diesel engine, the divided chamber forming the hot portion of the cylinder head and the head jacket being formed so as to encircle the divided chamber.

5. An overhead-valve type forced air-cooled engine according to claim 4, wherein:

a cooling air passage is formed, at portions other than the cylinder jacket, in the cylinder head.

6. A divided chamber type forced air-cooled engine having a radiator, a cooling fan provided for cooling the engine and a cylinder head secured on a cylinder block, said cylinder head being provided with a divided combustion chamber and a cooling air passage which being supplied with cooling air flows generated by the cooling fan so as to cool the cylinder head, comprising:

an oil-cooling head jacket around the divided chamber; and means for providing an oil flow adapted to circulate through the head jacket and the radiator.

7. A divided chamber type forced air-cooled engine according to claim 6, wherein:

an oil passage is formed transversely in a thick wall provided between an intake port and an exhaust port in the cylinder head and is connected in communication with the head jacket.

8. A divided chamber type forced air-cooled engine according to claim 7, wherein:

the oil passage is formed transversely in the lower side of the cylinder head, and the cooling air passage is formed longitudinally in an upper side thereof.

* * * * *